US009124001B2

(12) United States Patent
Wong et al.

(10) Patent No.: US 9,124,001 B2
(45) Date of Patent: Sep. 1, 2015

(54) COMMUNICATION DEVICE AND ANTENNA ELEMENT THEREIN

(71) Applicant: Acer Incorporated, New Taipei (TW)

(72) Inventors: Kin-Lu Wong, New Taipei (TW); Hsuan-Jui Chang, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 183 days.

(21) Appl. No.: 13/963,375

(22) Filed: Aug. 9, 2013

(65) Prior Publication Data

US 2014/0340277 A1 Nov. 20, 2014

(30) Foreign Application Priority Data

May 15, 2013 (TW) ..... 102117169 A

(51) Int. Cl.
*H01Q 1/24* (2006.01)
*H01Q 1/50* (2006.01)
*H01Q 5/371* (2015.01)

(52) U.S. Cl.
CPC . *H01Q 1/50* (2013.01); *H01Q 5/371* (2015.01)

(58) Field of Classification Search
CPC ..... H01Q 1/243; H01Q 5/50; H01Q 1/50
USPC ..... 343/702, 700 MS, 860, 866
See application file for complete search history.

(56) References Cited

U.S. PATENT DOCUMENTS 7,768,466 B2 8/2010 Chi et al.
2007/0229358 A1 * 10/2007 Chi et al. ..... 343/700 MS
2012/0162016 A1 6/2012 Lin

FOREIGN PATENT DOCUMENTS

JP 2008-252507 10/2008
TW 200943624 10/2009

OTHER PUBLICATIONS

Taiwanese language office action dated Jun. 29, 2015, issued in application No. TW 102117169.

* cited by examiner

*Primary Examiner* — Hoang V Nguyen
(74) *Attorney, Agent, or Firm* — McClure, Qualey & Rodack, LLP

(57) ABSTRACT

A communication device including a ground element and an antenna element is provided. The antenna element includes a metal element. The metal element has a plurality of bends and substantially forms a loop structure with a gap. The gap is between a first open end and a second open end of the metal element. The metal element extends along an edge of the ground element and does not overlap with the ground element. The antenna element has a feeding point. A first portion of the metal element is between the feeding point and the first open end, and a second portion of the metal element is between the feeding point and the second open end. The feeding point, the first open end, and the second open end are all facing or adjacent to the edge of the ground element.

8 Claims, 5 Drawing Sheets

COMMUNICATION DEVICE AND ANTENNA ELEMENT THEREIN

CROSS REFERENCE TO RELATED APPLICATIONS

This Application claims priority of Taiwan Patent Application No. 102117169 filed on May 15, 2013, the entirety of which is incorporated by reference herein.

BACKGROUND OF THE INVENTION

1. Field of the Invention

The disclosure generally relates to a communication device, and more particularly, relates to a communication device comprising a low-profile multi-band antenna element.

2. Description of the Related Art

With developments in the 4G mobile communication industry, human beings are requesting mobile communication devices to have a variety of functions, in addition to the conventional function of talking. To satisfy the requirements of multiple functions and to maintain the thin and small shapes of mobile communication devices, efficient use of limited space is very important. It is a critical challenge for antenna designers to design low-profile multi-band antenna elements which can be applied in thin mobile communication devices which meet future trends.

BRIEF SUMMARY OF THE INVENTION

The invention is aimed to provide a communication device comprising a low-profile multi-band antenna element. The antenna element has a simple structure, and is suitably applied to a thin tablet computer or a thin smart phone in particular.

In a preferred embodiment, the invention provides a communication device, comprising: a ground element; and an antenna element, comprising a metal element, wherein the metal element has a plurality of bends and substantially forms a loop structure with a gap, the gap is between a first open end and a second open end of the metal element, the metal element extends along an edge of the ground element and does not overlap with the ground element, the antenna element has a feeding point, a first portion of the metal element is between the feeding point and the first open end, and a second portion of the metal element is between the feeding point and the second open end; wherein the feeding point, the first open end, and the second open end are all facing or adjacent to the edge of the ground element, and a length of the second portion of the metal element is from 0.1 times to 0.4 times that of a length of the first portion of the metal element.

In some embodiments, the feeding point and the gap are both at a lateral side of the metal element, and the lateral side is facing the edge of the ground element. In this case, since the mutual coupling between the plurality of line segments of the metal element is generally not significant, the metal element may be made to have a long and narrow shape. Accordingly, the height of the whole metal element on the edge of the ground element is effectively reduced such that a low-profile appearance of the antenna element is achieved.

In some embodiments, the metal element is adjacent to a corner of the ground element and extends along two adjacent edges of the corner. In this case, the excited surface currents of the antenna element has two components which are substantially perpendicular to each other, and hence the vertically-polarized radiation fields of the antenna element is substantially equal to the horizontally-polarized radiation fields thereof. Accordingly, the antenna element is configured to receive and transmit both vertically-polarized and horizontally-polarized electromagnetic waves, and is suitably applied to complicated reception and transmission environments for mobile communication.

In some embodiments, when the metal element is adjacent to the corner of the ground element, the feeding point and the gap are adjacent to the two adjacent edges of the corner, respectively. The invention effectively uses a clearance region of the corner of the communication device to design the antenna element therein to achieve better impedance matching and better radiation efficiency.

In some embodiments, the metal element substantially has a hollow L-shape. In some embodiments, the metal element substantially has a hollow straight-line shape. In some embodiments, the ground element and the antenna element are disposed on a dielectric substrate. In some embodiments, the dielectric substrate is an FR4 (Flame Retardant 4) substrate. In some embodiments, a signal source is coupled through a matching circuit to the feeding point of the antenna element. In some embodiments, the matching circuit comprises a first capacitor, a second capacitor, and an inductor. The first capacitor is coupled between the signal source and the feeding point. The inductor is coupled between the feeding point and a ground voltage. The second capacitor is coupled between the feeding point and the ground voltage.

In some embodiments, the antenna element operates in a first band and a second band, and frequencies of the first band are lower than frequencies of the second band. In some embodiments, the first band is approximately from 704 MHz to 960 MHz, and the second band is approximately from 1710 MHz to 2690 MHz. The first portion of the metal element is excited to generate a first resonant mode in the first band, and the second portion of the metal element is excited to generate a second resonant mode in the second band. Since the length of the second portion is from 0.1 times to 0.4 times that of the length of the first portion, the first portion may be further excited to generate a high-order resonant mode in the second band. The high-order resonant mode is combined with the second resonant mode of the second portion to form a wide band such that the antenna element is capable of covering multiple bands. Note that because the second portion is adjacent to the first portion, some coupling is generated therebetween, causing the length of the second portion to be only equal to 0.17 wavelength of a central frequency of the second band. The foregoing length is less than the 0.25 wavelength of conventional designs. In some embodiments, the antenna element substantially has a planar structure. In some embodiments, a length of the antenna element is only equal to 60 mm, and a height of the antenna element is only equal to 6.5 mm.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the foregoing and other purposes, features and advantages of the invention, the embodiments and figures thereof in the invention are described in detail as follows.

Figure 1:
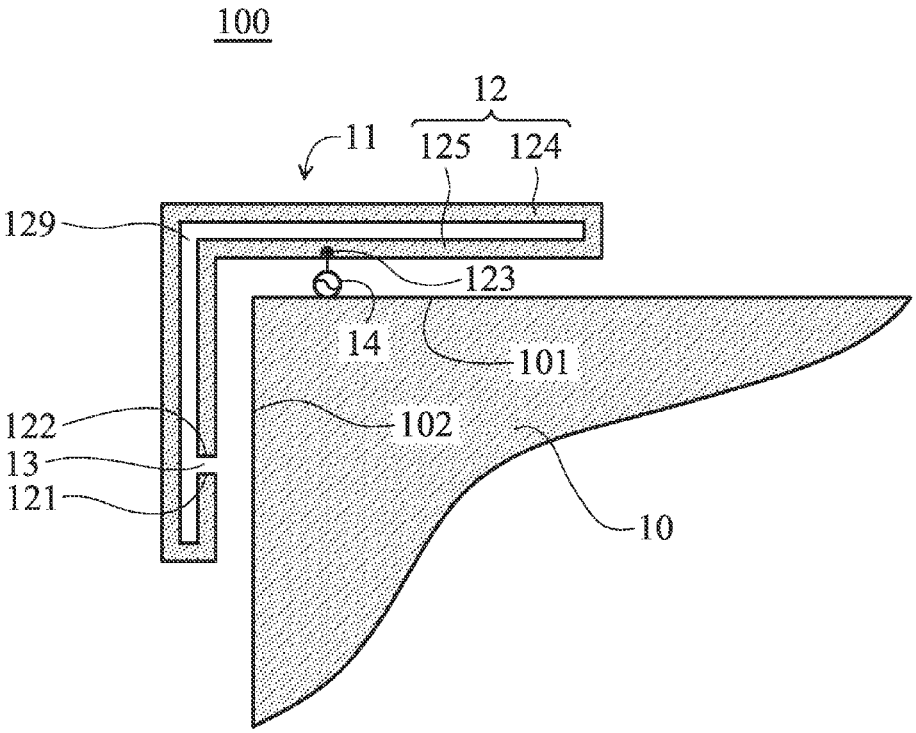
FIG. 1 is a diagram for illustrating a communication device according to a first embodiment of the invention.

FIG. 1 is a diagram for illustrating a communication device 100 according to a first embodiment of the invention. The communication device 100 may be a smartphone, a tablet computer, or a notebook computer. As shown in FIG. 1, the communication device 100 at least comprises a ground element 10 and an antenna element 11. The ground element 10 may be a metal plane disposed on a dielectric substrate (not shown), such as an FR4 (Flame Retardant 4) substrate or a system circuit board. The antenna element 11 comprises a metal element 12. The metal element 12 has a plurality of bends and substantially forms a loop structure with a gap 13. More particularly, the metal element 12 has a first open end 121 and a second open end 122, and the gap 13 of the loop structure is between the first open end 121 and the second open end 122. The metal element 12 extends along two adjacent edges 101 and 102 of the ground element 10, and does not overlap with the ground element 10. In some embodiments, the metal element 12 substantially has a hollow L-shape, and a central hollow portion 129 of the metal element 12 substantially has a smaller L-shape. The antenna element 11 has a feeding point 123 coupled to signal source 14. The metal element 12 comprises a first portion 124 and a second portion 125. The first portion 124 of the metal element 12 is between the feeding point 123 and the first open end 121. The second portion 125 of the metal element 12 is between the feeding point 123 and the second open end 122. The feeding point 123, the first open end 121, and the second open end 122 are all facing or adjacent to the adjacent edges 101 and 102 of the ground element 10. The length of the second portion 125 of the metal element 12 is from 0.1 times to 0.4 times that of the length of the first portion 124 of the metal element 12. The antenna element 11 can also be considered as a dual-branch antenna, in which the first portion 124 of the metal element 12 is a long branch, and the second portion 125 of the metal element 12 is a short branch. The long branch is excited to generate a low band, and the short branch is excited to generate a high band. In some embodiments, the metal element 12 is adjacent to a corner of the ground element 10, and extends along the adjacent edges 101 and 102 of the corner. In some embodiments, the feeding point 123 and the gap 13 are adjacent to the adjacent edges 101 and 102 of the corner, respectively. Note that the communication device 100 may further comprise other components, such as a touch panel, a processor, a speaker, a battery, and a housing (not shown).

Figure 2:
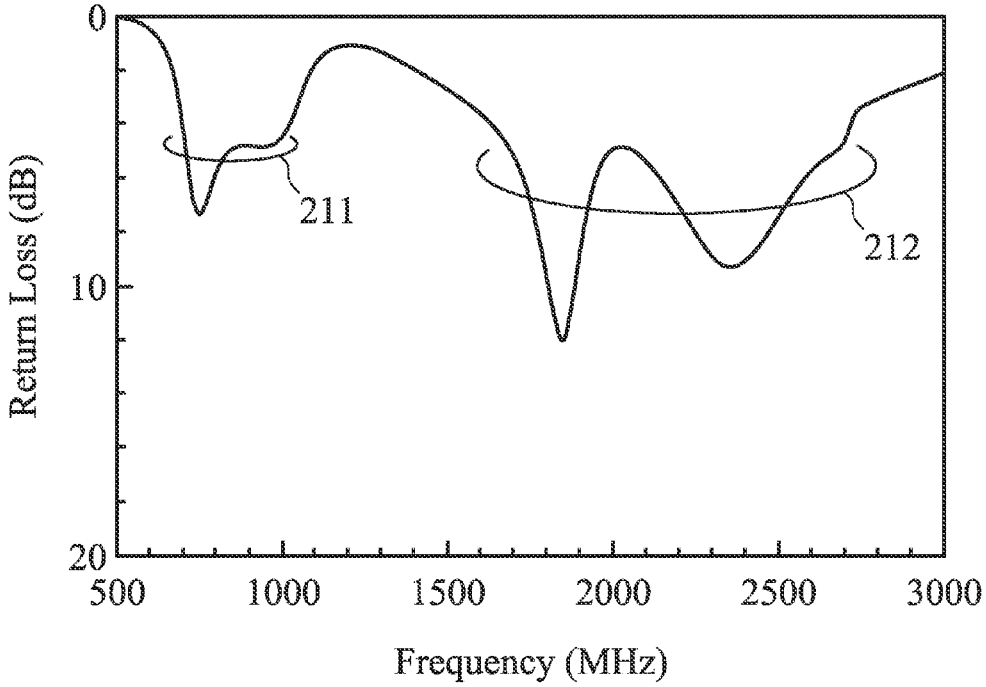
FIG. 2 is a diagram for illustrating return loss of an antenna element of a communication device according to a first embodiment of the invention.

FIG. 2 is a diagram for illustrating return loss of the antenna element 11 of the communication device 100 according to the first embodiment of the invention. In some embodiments, sizes and parameters of the elements of the invention are as follows. The area of the ground element 10 is approximately equal to 30000 $mm^2$ (200 mm by 150 mm). The antenna element 11 has a planar low-profile structure. The area of the antenna element 11 is approximately equal to 390 $mm^2$ (60 mm by 6.5 mm). The ground element 10 and the antenna element 11 are disposed on a dielectric substrate. The dielectric substrate may be an FR4 (Flame Retardant 4) substrate having a thickness of about 0.8 mm. The width of the gap 13 of the loop structure is approximately from 1 mm to 2 mm. The length of the first portion 124 of the metal element 12 is approximately equal to 105 mm. The length of the second portion 125 of the metal element 12 is approximately equal to 21 mm. As shown in FIG. 2, the antenna element 11 operates in a first band 211 and a second band 212. In some embodiments, the first band 211 covers LTE700/GSM850/900 bands (approximately from 704 MHz to 960 MHz), and the second band 212 covers GSM1800/1900/UMTS/LTE2300/2500 bands (approximately from 1710 MHz to 2690 MHz).

Figure 3:
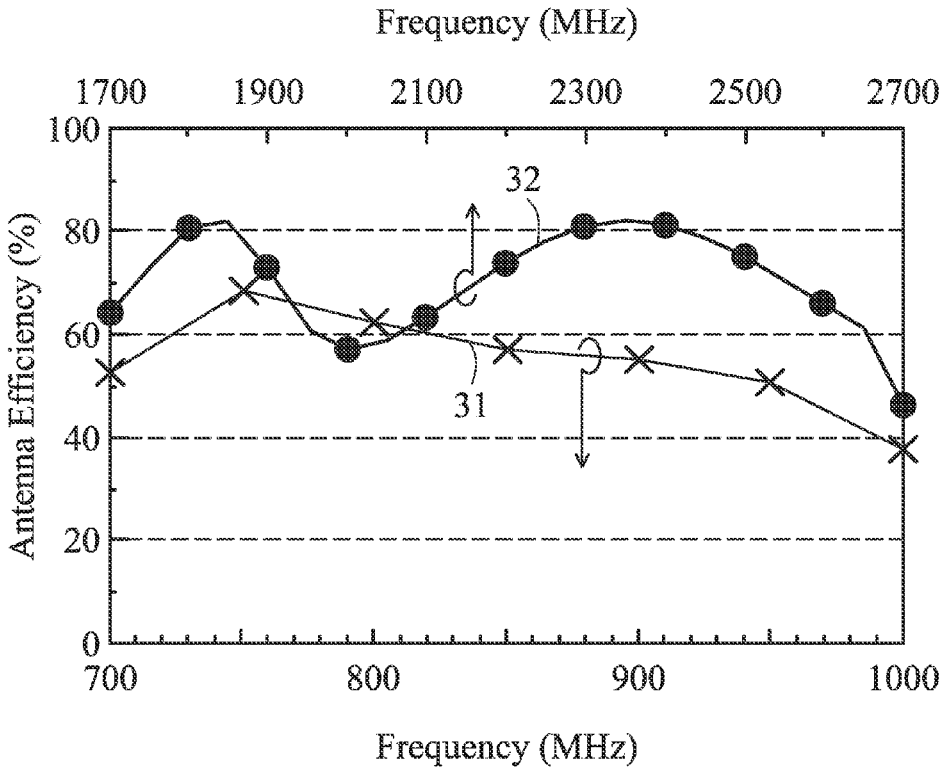
FIG. 3 is a diagram for illustrating antenna efficiency of an antenna element of a communication device according to a first embodiment of the invention.

FIG. 3 is a diagram for illustrating antenna efficiency of the antenna element 11 of the communication device 100 according to the first embodiment of the invention. The antenna efficiency curve 31 represents the antenna efficiency (return losses included) of the antenna element 11 operating in the LTE700/GSM850/900 bands (approximately from 704 MHz to 960 MHz). The antenna efficiency curve 32 represents the antenna efficiency (return losses included) of the antenna element 11 operating in the GSM1800/1900/UMTS/LTE2300/2500 bands (approximately from 1710 MHz to 2690 MHz). As shown in FIG. 3, the antenna efficiency of the antenna element 11 is approximately from 50% to 70% in the LTE700/GSM850/900 bands, and is approximately from 55% to 85% in the GSM1800/1900/UMTS/LTE2300/2500 bands. The antenna efficiency can meet application requirements.

Figure 4:
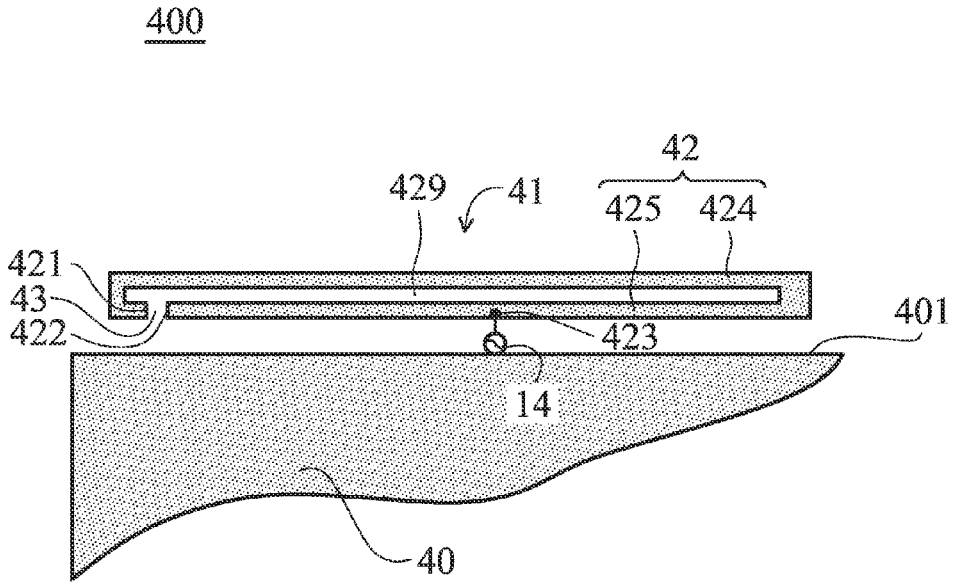
FIG. 4 is a diagram for illustrating a communication device according to a second embodiment of the invention.

FIG. 4 is a diagram for illustrating a communication device 400 according to a second embodiment of the invention. In the communication device 400 of the second embodiments, a metal element 42 of an antenna element 41 extends merely along an edge 401 of a ground element 40. A feeding point 423 of the antenna element 41 and a gap 43 are both at a lateral side of the metal element 42, and the lateral side is facing the edge 401 of the ground element 40. The metal element 42 substantially has a hollow straight-line shape, and a central hollow portion 429 of the metal element 42 substantially has a smaller straight-line shape. Other features of the second embodiment are similar to those of the first embodiment. Accordingly, the two embodiments can achieve similar performances.

Figure 5:
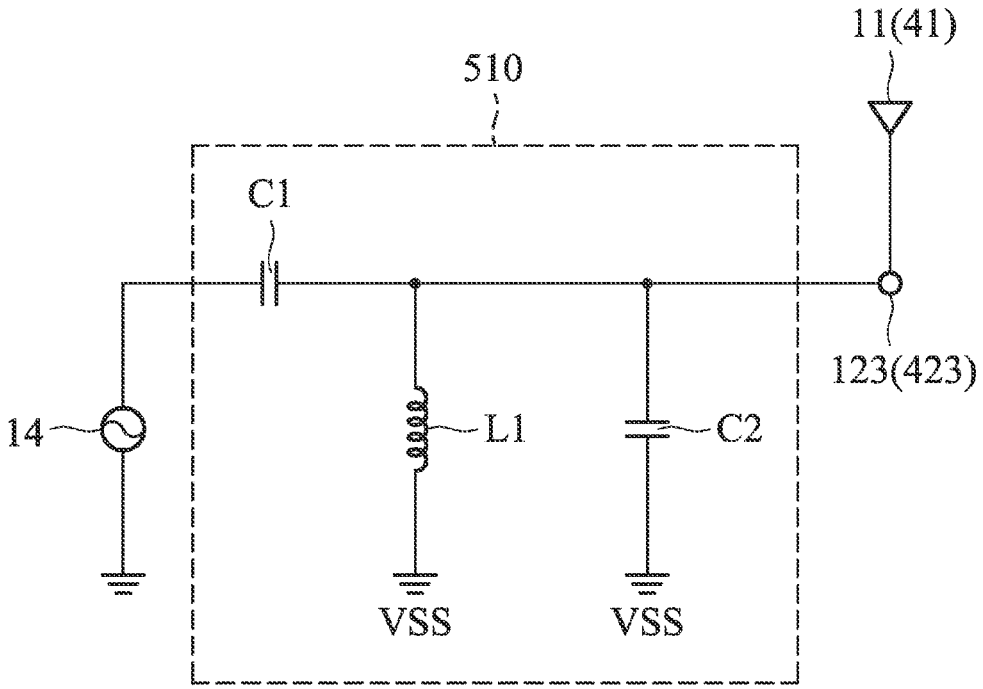
FIG. 5 is a diagram for illustrating a matching circuit according to an embodiment of the invention.

FIG. 5 is a diagram for illustrating a feeding matching circuit 510 according to an embodiment of the invention. As shown in FIG. 5, the signal source 14 may be further coupled through the matching circuit 510 to the antenna element 11 of the first embodiment or the antenna element 41 of the second embodiment. The matching circuit 510 comprises a first capacitor C1, a second capacitor C2, and an inductor L1. The first capacitor C1 is coupled between the signal source 14 and the feeding point 123 (or 423). The inductor L1 is coupled between the feeding point 123 (or 423) and a ground voltage VSS. The ground voltage VSS may be provided by the ground element 10 (or 40). The second capacitor C2 is coupled between the feeding point 123 (or 423) and the ground voltage VSS. In the embodiment of FIG. 5, the first capacitor C1 and the inductor L1 form a high-pass matching circuit for adjusting the impedance matching of the antenna element operating in the first band 211, and the second capacitor C2 forms a low-pass matching circuit for adjusting the impedance matching of the antenna element operating in the second band 212. Note that the matching circuit 510 is an optional component, and may be omitted in other embodiments.

Note that the above element sizes, element shapes, and frequency ranges are not limitations of the invention. An antenna designer can adjust the setting values according to different requirements.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A communication device, comprising:

a ground element; and an antenna element, comprising a metal element, wherein the metal element has a plurality of bends and substantially forms a loop structure with a gap, the gap is between a first open end and a second open end of the metal element, the metal element extends along an edge of the ground element and does not overlap with the ground element, the antenna element has a feeding point, a first portion of the metal element is between the feeding point and the first open end, and a second portion of the metal element is between the feeding point and the second open end;

wherein the feeding point, the first open end, and the second open end are all facing or adjacent to the edge of the ground element, and a length of the second portion of the metal element is from 0.1 times to 0.4 times that of a length of the first portion of the metal element;

wherein the metal element is adjacent to a corner of the ground element and extends along two adjacent edges of the corner;

and wherein the feeding point and the gap are adjacent to the two adjacent edges of the comer, respectively.

2. The communication device as claimed in claim 1, wherein the feeding point and the gap are both at a lateral side of the metal element, and the lateral side is facing the edge of the ground element.

3. The communication device as claimed in claim 1, wherein the antenna element operates in a first band and a second band, frequencies of the first band are lower than frequencies of the second band, the first portion of the metal element is excited to generate a first resonant mode in the first band, and the second portion of the metal element is excited to generate a second resonant mode in the second band.

4. The communication device as claimed in claim 3, wherein the first band is approximately from 704 MHz to 960 MHz, and the second band is approximately from 1710 MHz to 2690 MHz.

5. The communication device as claimed in claim 1, wherein the metal element substantially has a hollow L-shape.

6. The communication device as claimed in claim 1, wherein the metal element substantially has a hollow straight-line shape.

7. The communication device as claimed in claim 1, wherein a signal source is coupled through a matching circuit to the feeding point of the antenna element.

8. The communication device as claimed in claim 7, wherein the matching circuit comprises a first capacitor, a second capacitor, and an inductor, wherein the first capacitor is coupled between the signal source and the feeding point, the inductor is coupled between the feeding point and a ground voltage, and the second capacitor is coupled between the feeding point and the ground voltage.

* * * * *